US007017711B1

(12) United States Patent
Ali

(10) Patent No.: US 7,017,711 B1
(45) Date of Patent: Mar. 28, 2006

(54) METHOD FOR EXTENDING THE LEG OF A LADDER AND APPARATUS THEREFOR

(76) Inventor: Shaikh Mehboob Ali, House #66 Mir Khan Colony Airport Road Latifabad#12, Hyderabad (PK)

( * ) Notice: Subject to any disclaimer, the term of this patent is extended or adjusted under 35 U.S.C. 154(b) by 61 days.

(21) Appl. No.: 10/701,268

(22) Filed: Nov. 4, 2003

Related U.S. Application Data

(63) Continuation-in-part of application No. 10/278,482, filed on Oct. 23, 2002, now abandoned.

(51) Int. Cl.
*E06C 7/00* (2006.01)

(52) U.S. Cl. ..... 182/201; 182/172

(58) Field of Classification Search ..... 182/200–205, 182/107, 108, 172
See application file for complete search history.

(56) References Cited

U.S. PATENT DOCUMENTS 3,556,248 A * 1/1971 Brown et al. ..... 182/15
4,358,233 A * 11/1982 Morris et al. ..... 410/127
4,798,262 A * 1/1989 Margolies ..... 182/106
5,791,437 A * 8/1998 Figliuzzi ..... 182/172

FOREIGN PATENT DOCUMENTS

EP 172284 A1 * 2/1986

* cited by examiner

*Primary Examiner*—Alvin Chin-Shue
(74) *Attorney, Agent, or Firm*—Ted Masters

(57) ABSTRACT

An extender and method for extending the leg of a ladder can both lengthen and stabilize the leg of the ladder. The extender includes a first channel shaped and dimensioned to receive the leg of the ladder. A second channel is shaped and dimensioned to receive the first channel. A first and second members pivotally connect the first channel to the second channel. The second channel may be selectively moved from a stowed position wherein the first channel is received by the second channel, to an extended position wherein the second channel outwardly projects from the first channel and resides in substantially co-linear relationship with the first member. A lock is selectively connectable between the first channel and the second channel to retain the second channel in the extended position. A retainer fixedly attaches the extender to a desired position along the leg of the ladder.

3 Claims, 13 Drawing Sheets

502
20
22
26
36
34
30
36
28
24
34
36
600

500
502
20
600
504
600
29

METHOD FOR EXTENDING THE LEG OF A LADDER AND APPARATUS THEREFOR

CROSS REFERENCE TO RELATED APPLICATION

This application is a Continuation in Part of application Ser. No. 10/278,482, filed Oct. 23, 2002 now Abandoned, which is included herein by reference.

TECHNICAL FIELD

The present invention pertains generally to ladders, and more particularly to leg extenders which may be attached to each of the legs of the ladder to increase the ladder's height and/or to provide increased ladder stability.

BACKGROUND OF THE INVENTION

Folding ladders commonly known as "stepladders" are well known in the art. These devices consist of a ladder having two side rails, a plurality of rungs or steps, and a opposing support member which is hinged to the ladder so that a stable inverted V shape structure may be achieved. A hinged spreader connects the ladder and the support member, and limits the spread of the ladder and support member. The top of the ladder has a head step. Near the top, many stepladders also have a pail rest upon which various articles such as tools and containers may be placed.

For example, U.S. Pat. No. 4,276,955 shows a folding portable multiple-purpose work unit is interchangeably useable in three main work modes: as a stepladder, as a step stool, and as a small workbench having a vise. The substructure of the unit includes front and rear leg frames, the front frame having two steps, and is foldable to allow ready storage of the unit. The vise unit forms the top of the substructure. A seat member covers the vise unit when the work unit is in the step stool and stepladder modes and pivots to uncover the vise unit in the workbench mode. When so pivoted off the vise unit, the seat member forms a tool tray which also blocks use of the work unit as a stool or ladder while the seat is not in place. The work unit also includes a handrail which is movable between a raised position in the stepladder mode, where it affords support to a user standing on the steps or seat of the unit, and a lowered position in the workbench or step stool mode, where it is out of the user's way and also facilitates storage of the unit. The substructure of the work unit is latched in the erect position by a pair of hooks carried by a latching rod, the hooks engaging with abutment surfaces on abutment blocks connected to the upper ends of the legs of the substructure. The latching rod carries a release member in its central region which, when the seat is in position, can be rotated and lifted to cause release of the latching mechanism and automatic folding of the substructure.

U.S. Pat. No. 4,460,063 illustrates a step ladder work bench apparatus for significantly increasing the top shelf area on step ladders. Apparatus is hingedly attached to said step ladder allowing apparatus to be raised and hooked in place for use and lowered against step ladder rails for storage.

U.S. Pat. No. 5,722,507 discloses a platform stool which includes a frame having a front leg and a rear leg. The front leg is pivotably coupled to the rear leg for movement about a leg pivot axis between an opened position and a closed position. The platform stool includes a multi-part platform including a front section pivotably coupled to the front leg and a rear section pivotably coupled to the rear leg, each of the front and rear sections having a top surface. A platform support linkage couples the front section to the rear section for movement about a platform pivot axis between a platform-forming position wherein the top surface of the front section and the top surface of the rear section are aligned in substantially coplanar relation to form a platform and a platform-collapsing position wherein the top surface of the front section faces away from the rear leg and the top surface of the rear section faces away from the front leg. The front and rear legs cooperate with the multi-part platform so that the front and rear legs are in the opened position when the front and rear sections are in the platform-forming position and the front and rear legs are in the closed position when the front and rear sections are in the platform-collapsing position. The stool has feet attached to each leg to provide stability.

U.S. Pat. No. 5,913,380 consists of a ladder accessory in the form of a toolbox. The toolbox is coupled to support brackets mounted on each front leg of a conventional ladder. The toolbox includes a handle that allows for securing to the brackets when the cover is opened by forcing pinions located in the bottom of the box through pinion apertures located on each support bracket. The support bracket allows lifting of the toolbox so as to provide a safe working area for a worker on top of the ladder allowing ease of access to the necessary tools in order to accomplish a particular task. Bracket release levers are provided on each support bracket to allow lifting of the toolbox in a convenient manner.

U.S. Pat. No. 6,131,699 describes a ladder tray attachment for mounting to a head step of a stepladder for resting objects thereon. The ladder tray attachment includes a tray and a mounting frame for mounting the tray to a head step of a stepladder. The mounting frame comprises a spaced apart pair of generally inverted L-shaped mounting members each has elongate top and bottom portions. The bottom portions of the mounting members are coupled to the tray such that the top portions of the mounting members outwardly extend from the tray. The mounting members each also have an elongate hooking portion downwardly depending from the top portion of the respective mounting member. The hooking portions of the mounting members each have spaced apart upper and lower hooks outwardly extending therefrom in a direction towards the bottom portions of the respective mounting member.

SUMMARY OF THE INVENTION

The present invention is directed to an extender and method for extending the leg of a ladder. The extender is selectively connectable to a desired position along the leg of the ladder. Once so connected, the extender may be moved from a stowed not in use position to an extended in use position where it serves as an outrigger. The extender can both increase the length of the ladder leg, and stabilize the leg by providing an extending brace. The extender may be utilized to keep the ladder even on an uneven support surface, by selectively adjusting the position of the extender along the leg to compensate for level variations in the support surface.

A method for extending the leg of a ladder, includes:

(a) providing a ladder having a leg having a foot;

(b) providing an extender for the leg of the ladder, the extender including:

a first channel shaped and dimensioned to receive the leg of the ladder;

a second channel shaped and dimensioned to receive the first channel;

a first member pivotally connecting the first channel to second channel;

a second member pivotally connecting the first channel to the second channel;

wherein the second channel may be selectively moved from a stowed position wherein the leg is received by the first channel and the first channel is received by the second channel, to an extended position wherein the second channel outwardly projects from the first channel and resides in substantially co-linear relationship with the first member;

a lock selectively connectable between the first channel and the second channel to retain the second channel in the extended position;

a retainer for fixedly attaching the extender to the leg of the ladder;

(c) using the retainer to attach the first channel to a desired position along the leg of the ladder wherein the first channel receives the leg of the ladder;

(d) placing the second channel in the extended position; and, (e) using the lock to retain the second channel in the extended position.

Other aspects of the present invention will become apparent from the following detailed description, taken in conjunction with the accompanying drawings, which illustrate, by way of example, the principles of the invention.

DETAILED DESCRIPTION OF THE INVENTION

Referring initially to FIGS. 1–5 and 7–8, there are illustrated top plan, side elevation, elevation, opposite side elevation, opposite elevation, partially extended side elevation, and extended side elevation views respectively of an extender for the leg of a ladder in accordance with the present invention, the extender generally designated as 20. It is noted that in FIGS. 1–5 extender 20 is in a stowed position, in FIG. 7 extender 20 is in a partially extended position, and in FIG. 8 extender 20 is in an extended (fully extended) position.

Figures 1, 2, 3, 4, 5:
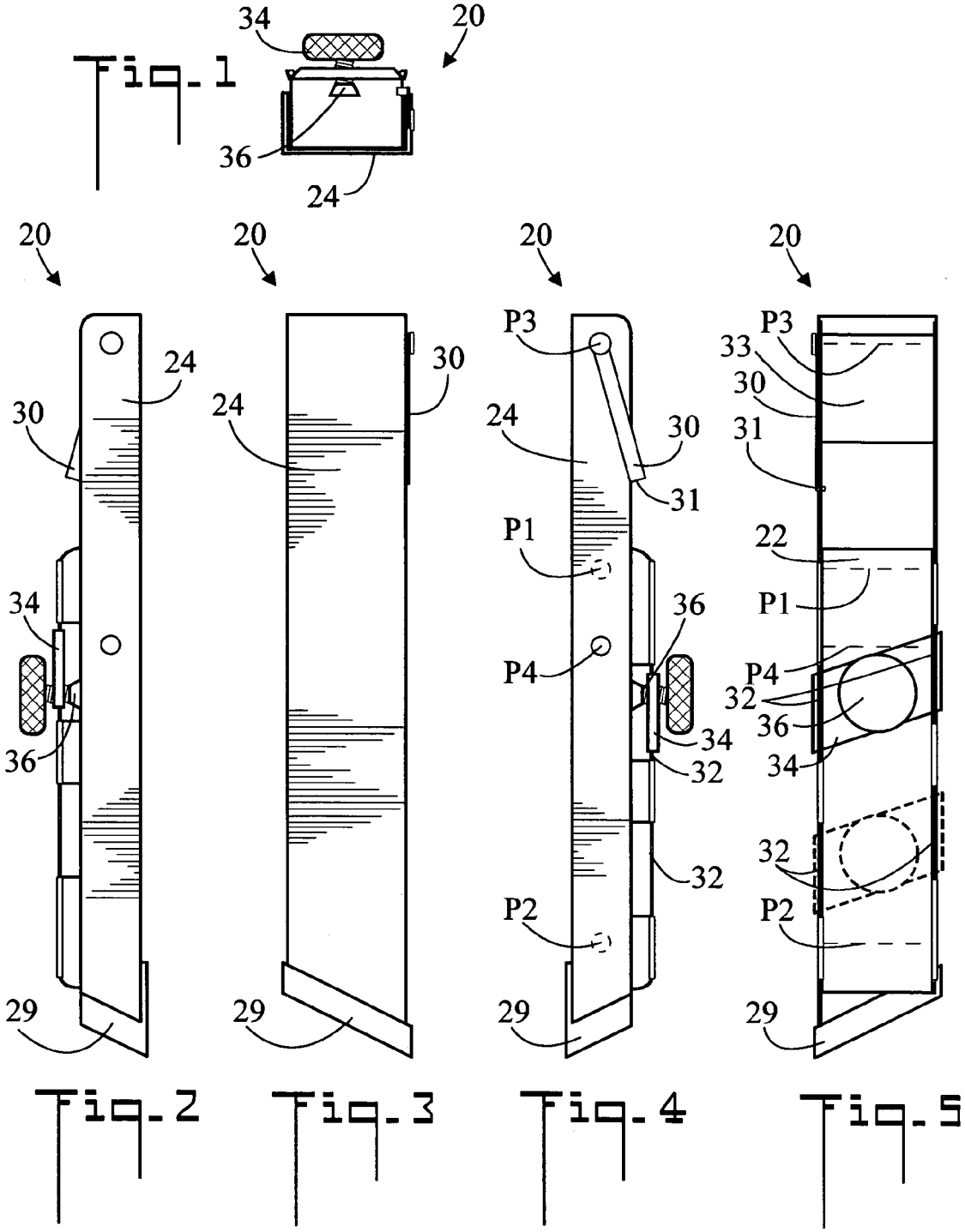
FIG. 1 is a top plan view of an extender for the leg of a ladder in accordance with the present invention, the extender being in the stowed position.
FIG. 2 is a side elevation view of the extender.
FIG. 3 is an elevation view of the extender.
FIG. 4 is an opposite side elevation view of the extender.
FIG. 5 is an opposite elevation view of the extender.
Figure 7:
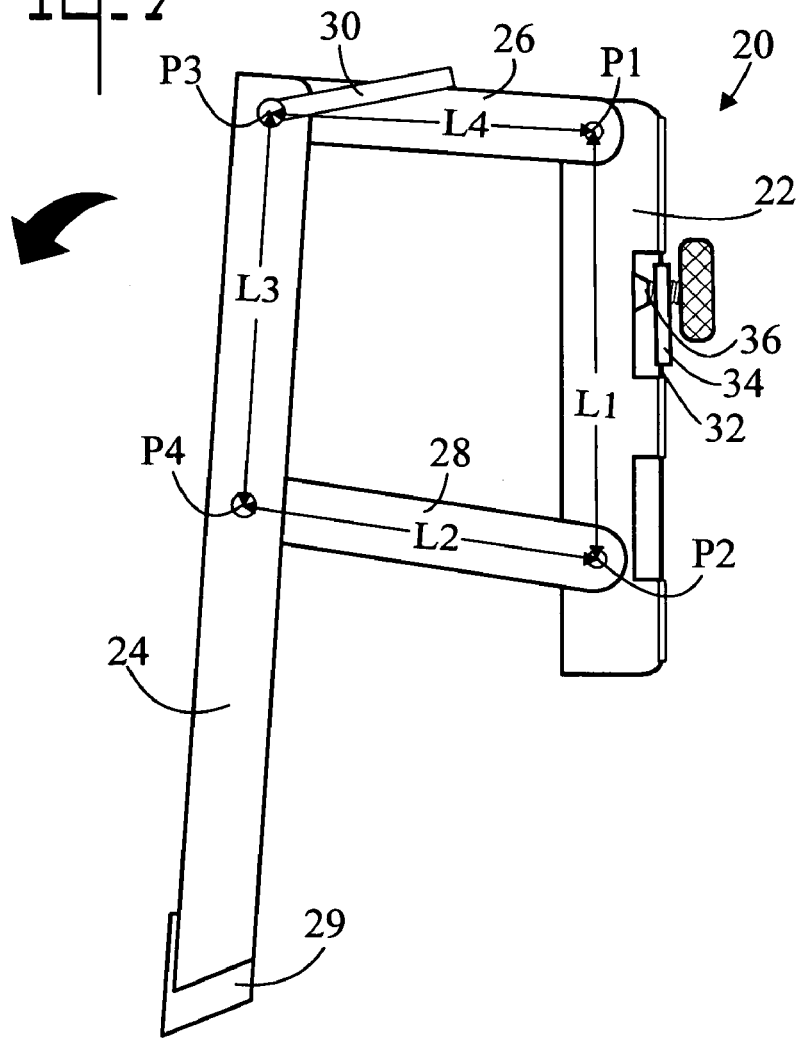
FIG. 7 is a side elevation view of the extender in a partially extended position.
Figure 8:
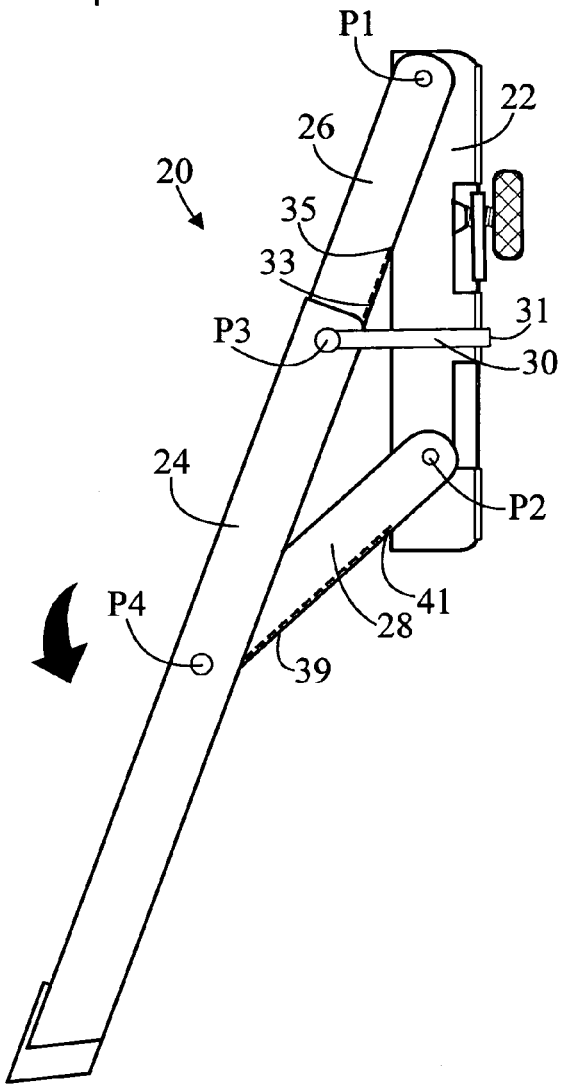
FIG. 8 is a side elevation view of the extender in an extended position.
Figure 14:
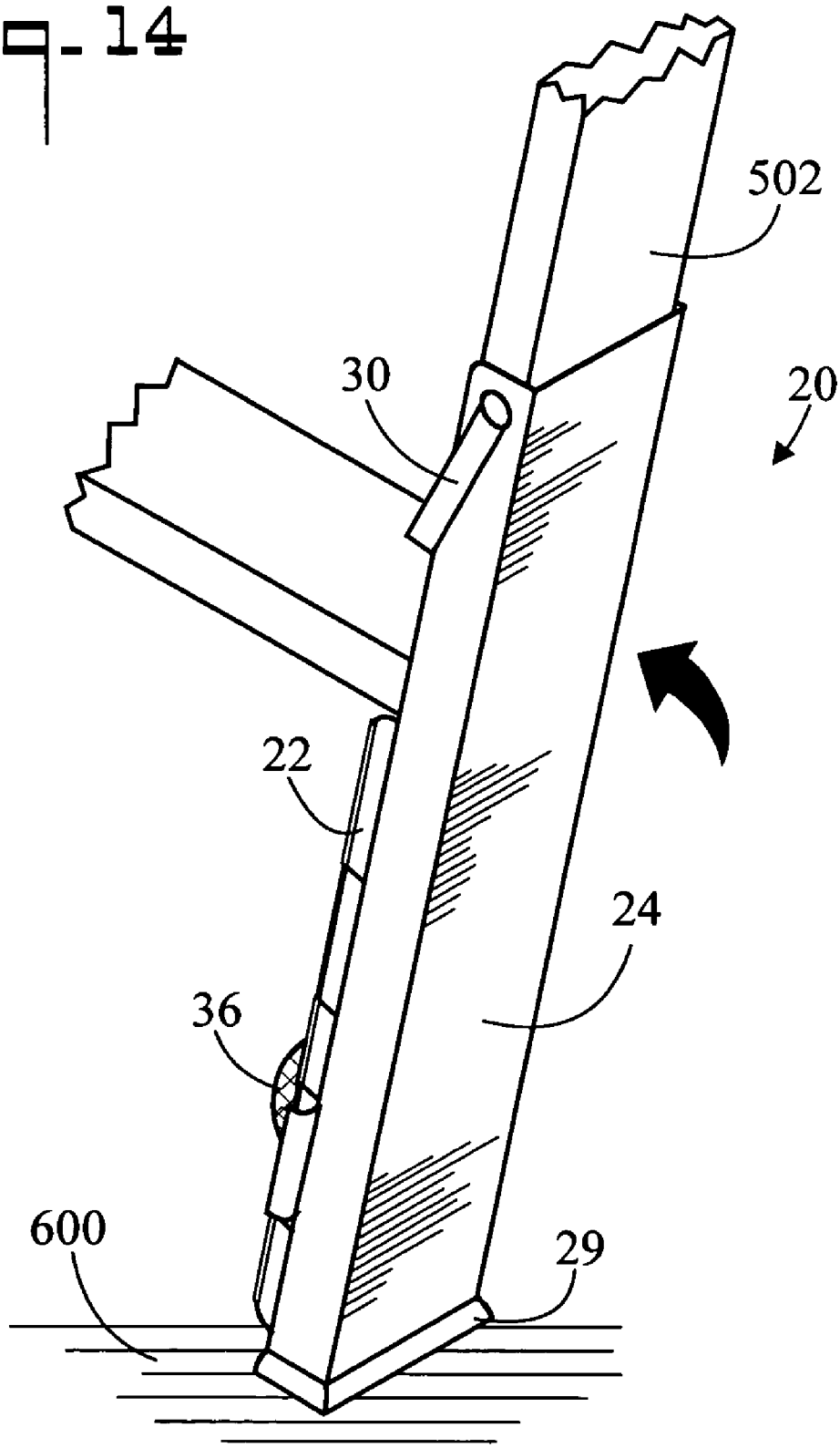
FIG. 14 is a perspective view of the extender installed on the leg of the ladder with the second channel of the extender moved to the stowed position.
Figure 15:
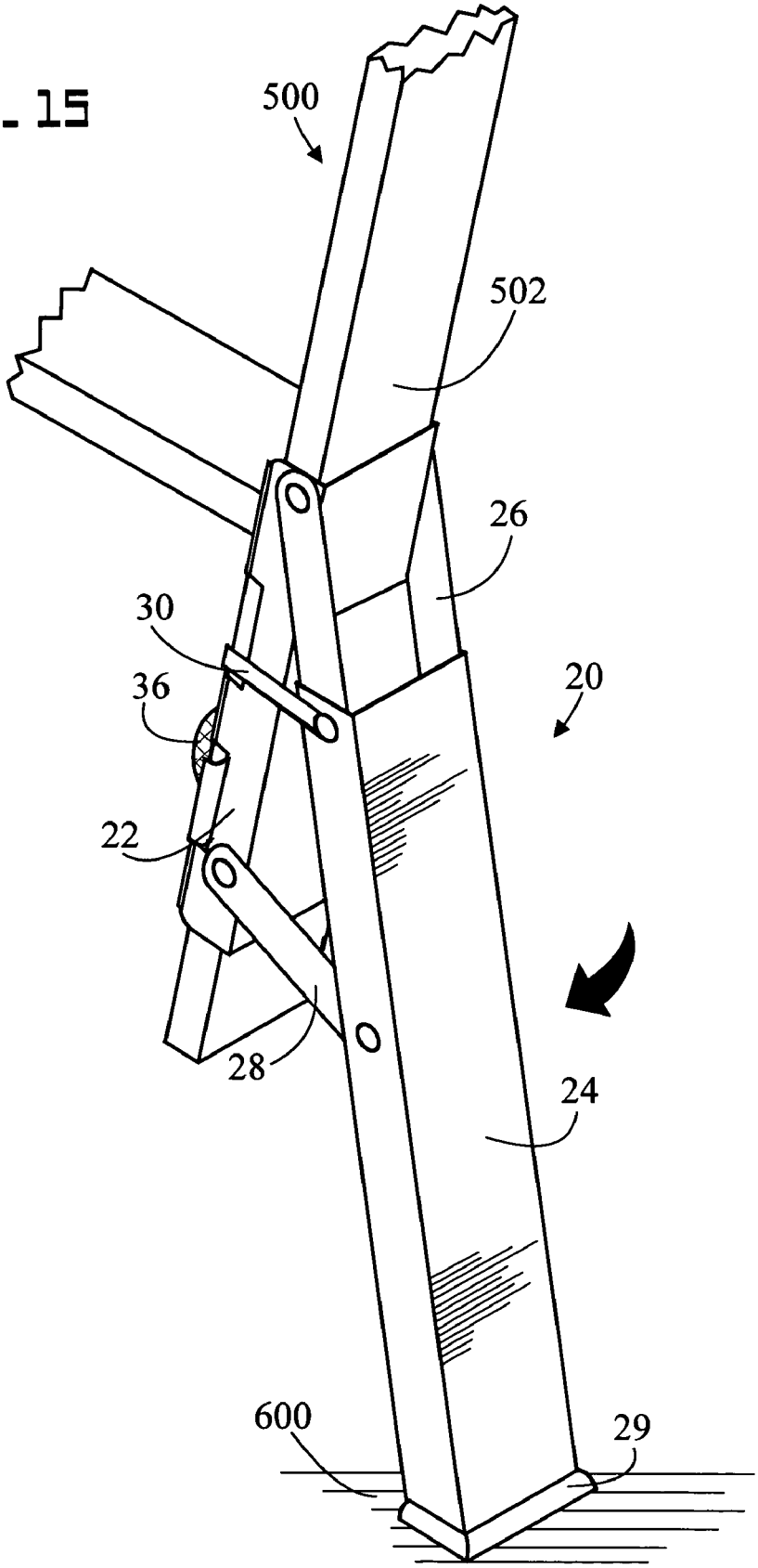
FIG. 15 is a perspective view of the extender installed on the leg of the ladder with the second channel of the extender in the extended position.

Extender 20 includes a first channel 22 which is shaped and dimensioned to receive the leg 502 of the ladder 500 (refer also to FIGS. 14 and 15). A second channel 24 is shaped and dimensioned to receive first channel 22 in nested relationship. A first member 26 pivotally connects first channel 22 to second channel 24 (refer also to FIG. 9). A second member 28 also pivotally connects first channel 22 to second channel 24 (refer also to FIG. 10). Second channel 24 may be selectively moved from a stowed position (as shown in FIGS. 1–5) wherein leg 502 is received by first channel 22 and first channel 22 is received by second channel 24, to an extended position wherein second channel 24 outwardly projects from first channel 22 and resides in substantially co-linear relationship with first member 26 (refer to FIG. 8). The transition of second channel 24 from the stowed position to the extended position is depicted in FIGS. 4, 7, and 8.

The physical relationship of first channel 22, second channel 24, first member 26, and second member 28 is an important feature of the present invention. The relationship is chosen so that second channel 24 will exactly move from the stowed position of FIG. 4 to the extended position of FIG. 8. Referring to FIG. 7, first member 26 is connected to first channel 22 at a first pivot axis P1. Second member 28 is connected to first channel at a second pivot axis P2. First member 26 is connected to second channel at a third pivot axis P3. Second member 28 is connected to second channel at a fourth pivot axis P4. In the side view of FIG. 7 the four axes P1–P4 appear as points, and in the view of FIGS. 5, 9, and 10 they appears as lines. The distance from P1 to P2 is defined as L1, the distance from P2 to P4 is defined as L2, the distance from P4 to P3 is defined as L3, and the distance from P3 to P1 is defined as L4. In order for second channel 24 to move from the stowed position of FIG. 4 to the extended position of FIG. 8, the following relationships must apply:

the ratio of L1 to L2 is about 1.2;

the ratio of L1 to L3 is about 1.1; and, the ratio of L1 to L4 is about 1.4.

That is, L1 must be about 1.2 times L2, about 1.1 times L3, and about 1.4 times L4.

It is noted that in order to fit all legs 502 of ladder 500 both right and left handed versions of extender 20 must be provided. Also, extender 20 includes anti-slip feet 29 which prevent extender 20 from slipping when placed upon a support surface 600 (refer to FIG. 14).

Referring now to FIGS. 4, 5, and 8, extender 20 further includes a lock which is selectively connectable between first channel 22 and second channel 24 to retain second channel 24 in the extended position. In the shown embodiment, lock comprises a locking strap 30 having a hooked end 31 which is pivotally connected to second channel 24. The locking strap 30 may be selectively rotated and attached to first channel 22, wherein hooked end 31 engages first channel 22 and retains extender 20 in the extended position of FIG. 8.

Figures 11, 12, 13:
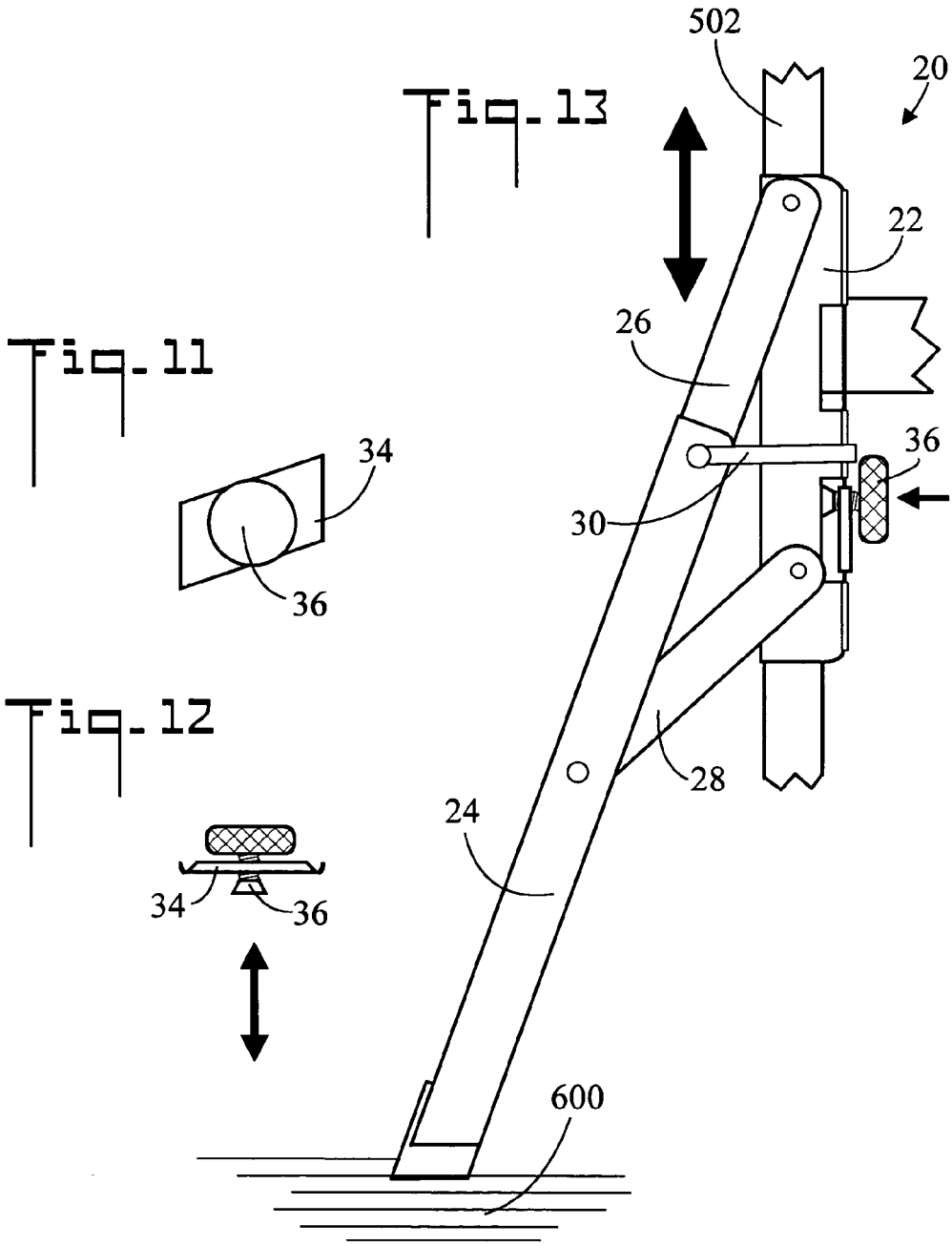
FIG. 11 is a top plan view of an insert having a screw.
FIG. 12 is a side elevation view of the insert and screw.
FIG. 13 is a side elevation view of the extender installed on the leg of a ladder with a second channel of the extender in the extended position.

Extender 20 further includes a retainer for fixedly attaching extender 20 to a desired position along the leg 502 of the ladder 500 (refer also to FIG. 13). In the shown embodiment, the retainer includes first channel 22 having two sides, each side having an open rod 32. An insert 34 is selectively connectable between two open rods 32. A screw 36 is threadably connected to insert 34. Insert 34 has curved ends 38 which can engage open rods 32, wherein insert 34 engages two open rods 32 and screw 36 (refer to FIG. 6) may be turned to engage the leg 502 of the ladder 500 and thereby fixedly hold first channel 22 in place on the leg 502 of the ladder 500 (refer to FIG. 6). In an embodiment of the invention, first channel 22 includes two pairs of open rods 32 wherein insert 34 may be connected between either pair (refer to FIG. 5). It is further noted that insert 34 and attached screw 36 are separate parts not permanently connected to extender 20.

Figure 6:
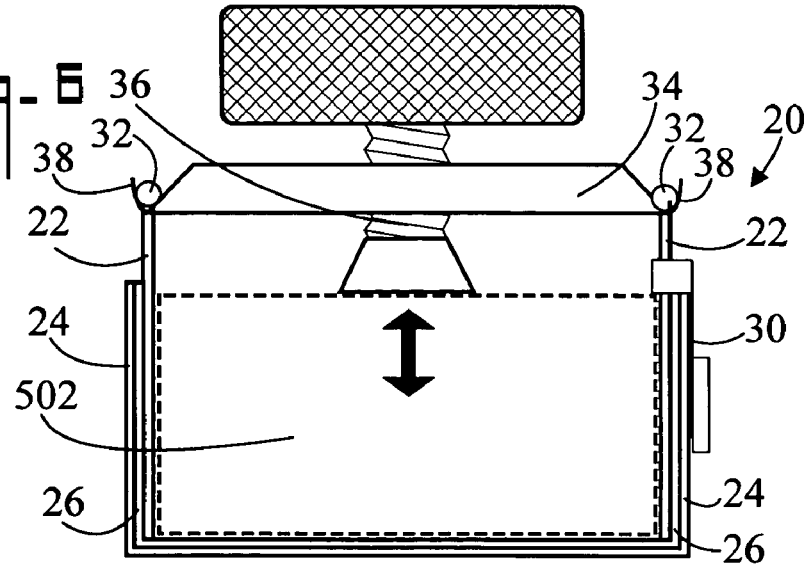
FIG. 6 is an enlarged top plan view of the extender in the stowed position.

FIG. 6 is an enlarged top plan view of the extender in the stowed position.

Figure 9:
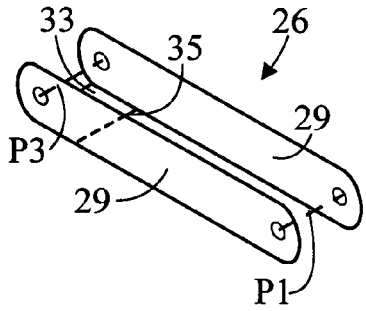
FIG. 9 is a perspective view of a first member.
Figure 10:
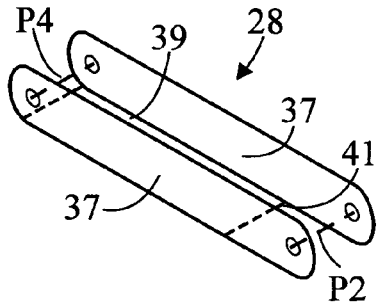
FIG. 10 is a perspective view of a second member.

Referring now to FIGS. 9 and 10, there are illustrated perspective views of first member 26 and second member 28 respectively. First member 26 includes a first pair of arms 29 connected by a first bridge 33. First bridge 33 has an edge 35 which contacts first channel 22 when second channel 24 is in the extended position (refer also to FIG. 8). Second member 28 includes a second pair of arms 37 connected by a second bridge 39. Second bridge 39 has an edge 41 which contacts first channel 22 when second channel 24 is in the extended position (refer also to FIG. 8).

FIGS. 11 and 12 are top plan and side elevation views respectively of insert 34 having attached screw 36. When installed in extender 20, as screw 36 is turned it moves either toward (to engage) or away from leg 502 of ladder 500 (refer also to FIG. 6).

FIG. 13 is a side elevation view of extender 20 installed on the leg 502 of ladder 500 with second channel 24 of extender 20 in the extended position. Screw 36 has been turned to fixedly lock first channel 22 in place along leg 502 of ladder 500. It may be appreciated that first channel 22 of extender 20 may be selectively positioned up or down to a desired position along leg 502. The anti-slip foot 29 of extender 20 resides on a support surface 600.

FIG. 14 is a perspective view of extender 20 installed on leg 502 of ladder 500 with the second channel 24 of extender 20 moved to the stowed position so that extender 20 is closely disposed along leg 502. In this position extender 20 is not in use.

FIG. 15 is a perspective view of extender 20 installed on leg 502 of ladder 500 with second channel 24 in the extended position. Lock 30 holds second channel 24 in the extended position. Foot 29 of second channel 24 resides on support surface 600.

Figure 16:
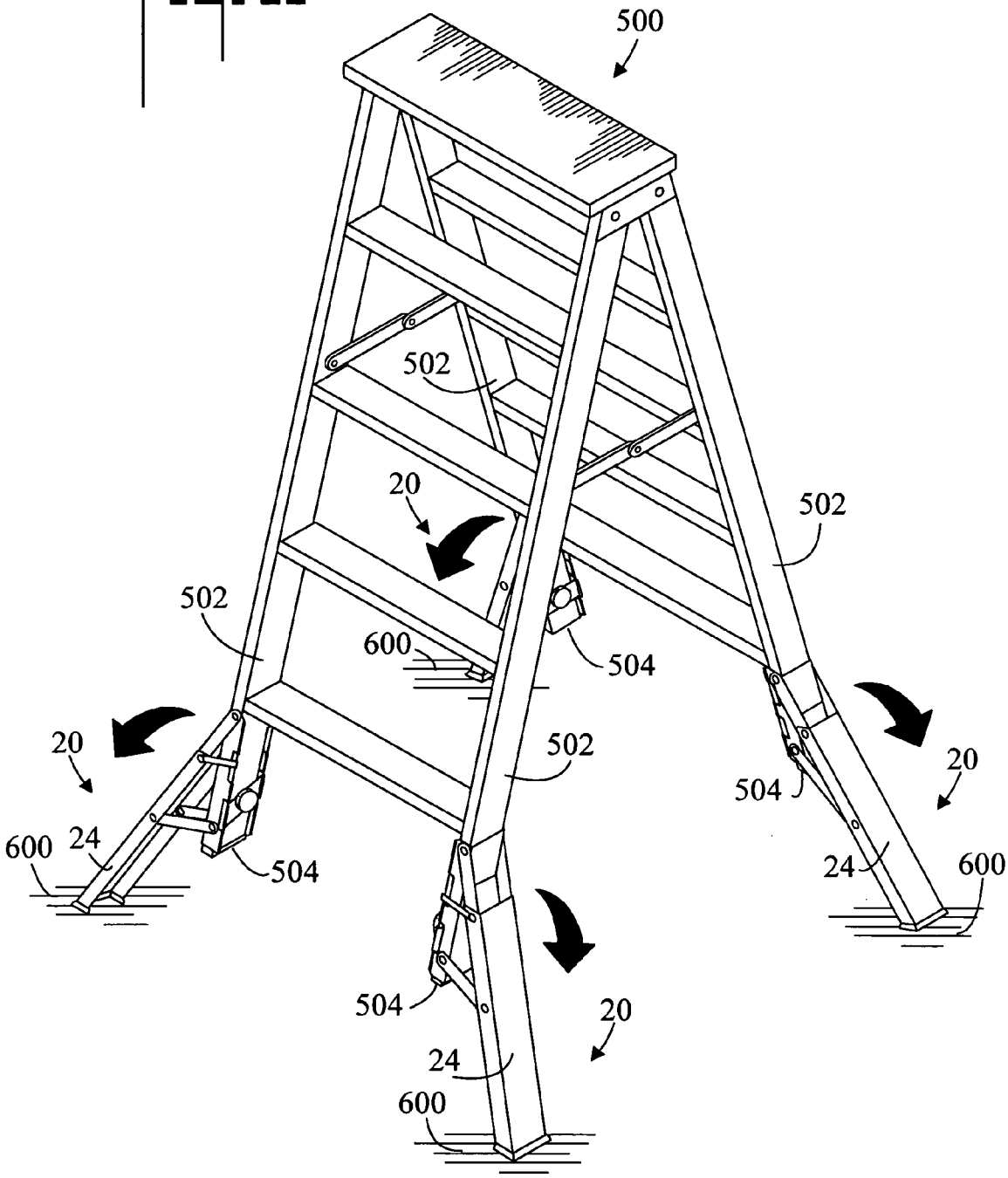
FIG. 16 is a reduced perspective view of four extenders connected to four legs of the ladder.

FIG. 16 is a reduced perspective view of four extenders 20 connected to four legs 502 of ladder 500 with the extenders 20 residing on support surface 600. An extender 20 has been attached to each leg 502 of ladder 500, and the second channels 24 of each extender have been placed and locked in the downward extended position. Extenders 20 have been positioned on leg 502 so that extenders 20 extend below the feet 504 of the legs 502 of ladder 500, so that in this embodiment extenders 20 both lengthen legs 502 and stabilize ladder 500. Also in FIG. 16, the four extenders 20 are all attached an equal distance from the foot 504 of the corresponding legs 502, so that ladder 500 rests evenly on flat support surface 600.

Figure 17:
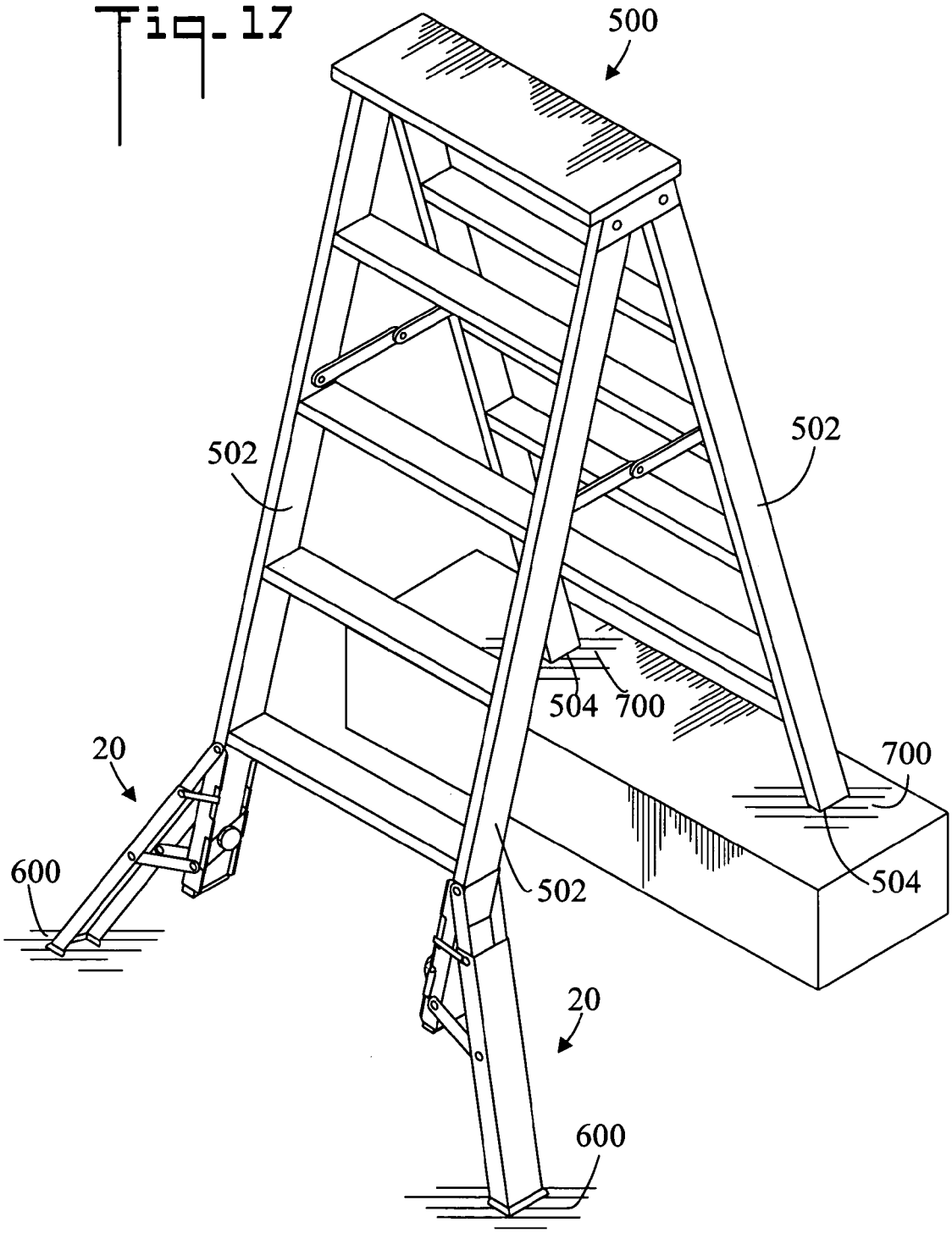
FIG. 17 is a reduced perspective view of two extenders connected to two legs of the ladder.

FIG. 17 is a reduced perspective view of two extenders 20 connected to two legs 502 of ladder 500. This embodiment is useful when ladder 500 must be set on two support surfaces 600 and 700, and the two support surfaces are of different heights. As such, extenders 20 have been attached to two legs 502 of ladder 500 with extenders 20 resting on lower support surface 600. The feet 504 of the other two legs 502 rest upon higher support surface 700. In this fashion ladder 500 rests evenly on the two support surfaces. It may similarly be appreciated that extender 20 may be positioned along leg 502 of ladder 500 so that extender 20 causes ladder 500 to rest evenly on any support surface. For example, if one leg 502 of ladder 500 was positioned over a depression, extender 20 could be attached to that leg 502 to even ladder 500. This principle can be extended to accommodate any uneven support surface wherein four extenders 20 are not all attached an equal distance from foot 504 of the corresponding leg 502.

Figure 18:
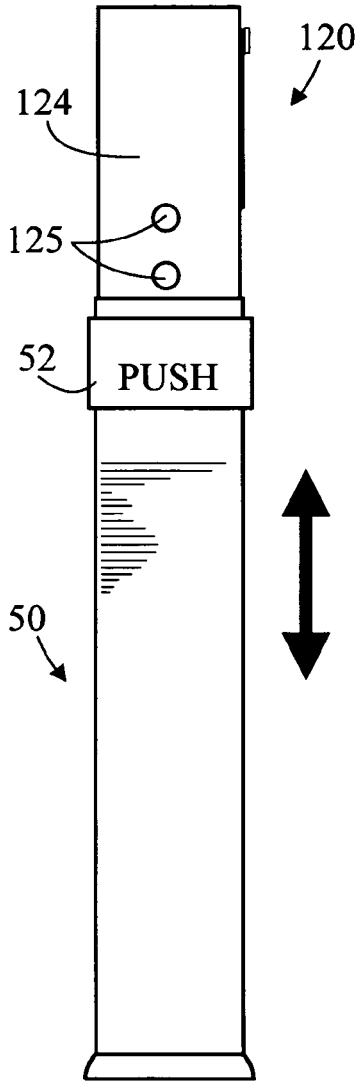
FIG. 18 is an elevation view of a second embodiment of the extender.
Figure 19:
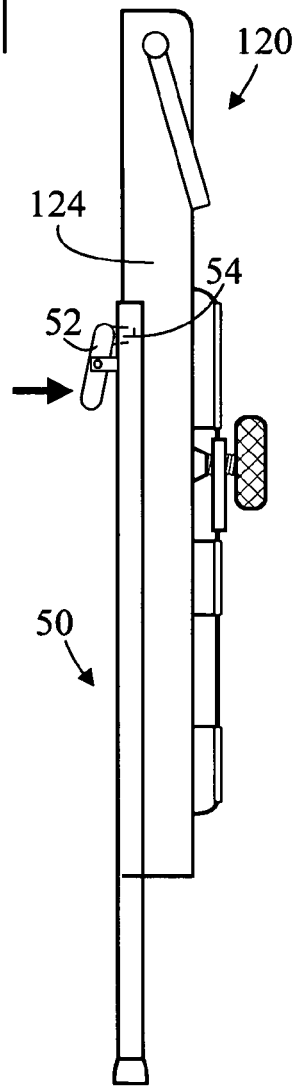
FIG. 19 is a side elevation view of the second embodiment.

FIGS. 18 and 19 are elevation and side elevation views respectively of a second embodiment of the extender, generally designated 120. Extender 120 comprises a modified extender 20 to which has been added an extension 50. In this embodiment second channel 124 has a plurality of spaced holes 125, and extension 50 has a latch 52 having a pin 54 which is shaped and dimensions to engage one of holes 125. Extension 50 is selectively connectable to second channel 124 wherein pin 54 of latch 50 engages one of the plurality of spaced holes 125 in second channel 124. By moving extension 50 up or down along second channel 124, the position of extension 50 along second channel 124 may be changed thereby shortening or lengthening extender 120.

Figure 20:
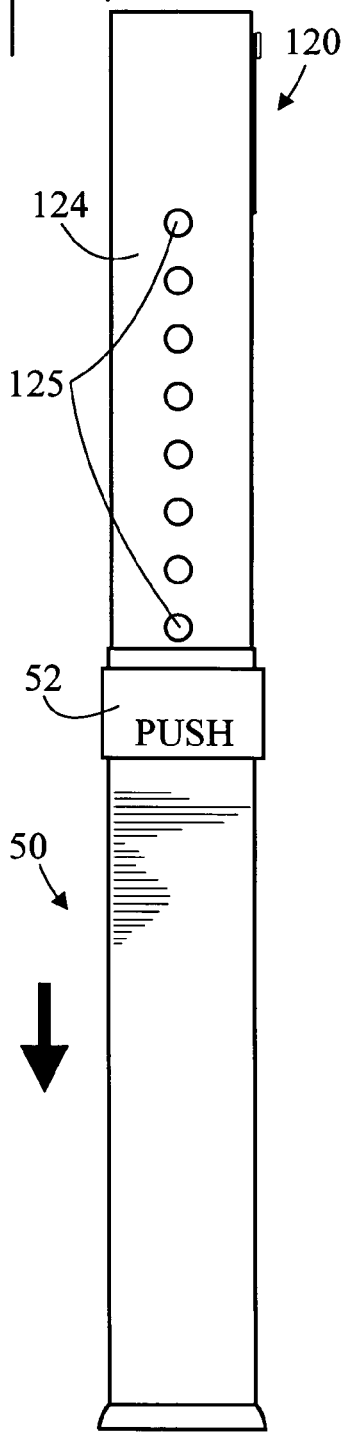
FIG. 20 is an elevation view of an extension moved to a lower hole along the second channel.

FIG. 20 is an elevation view of extension 50 moved to a lower hole 125 along second channel 124, thereby lengthening extender 120.

Figure 21:
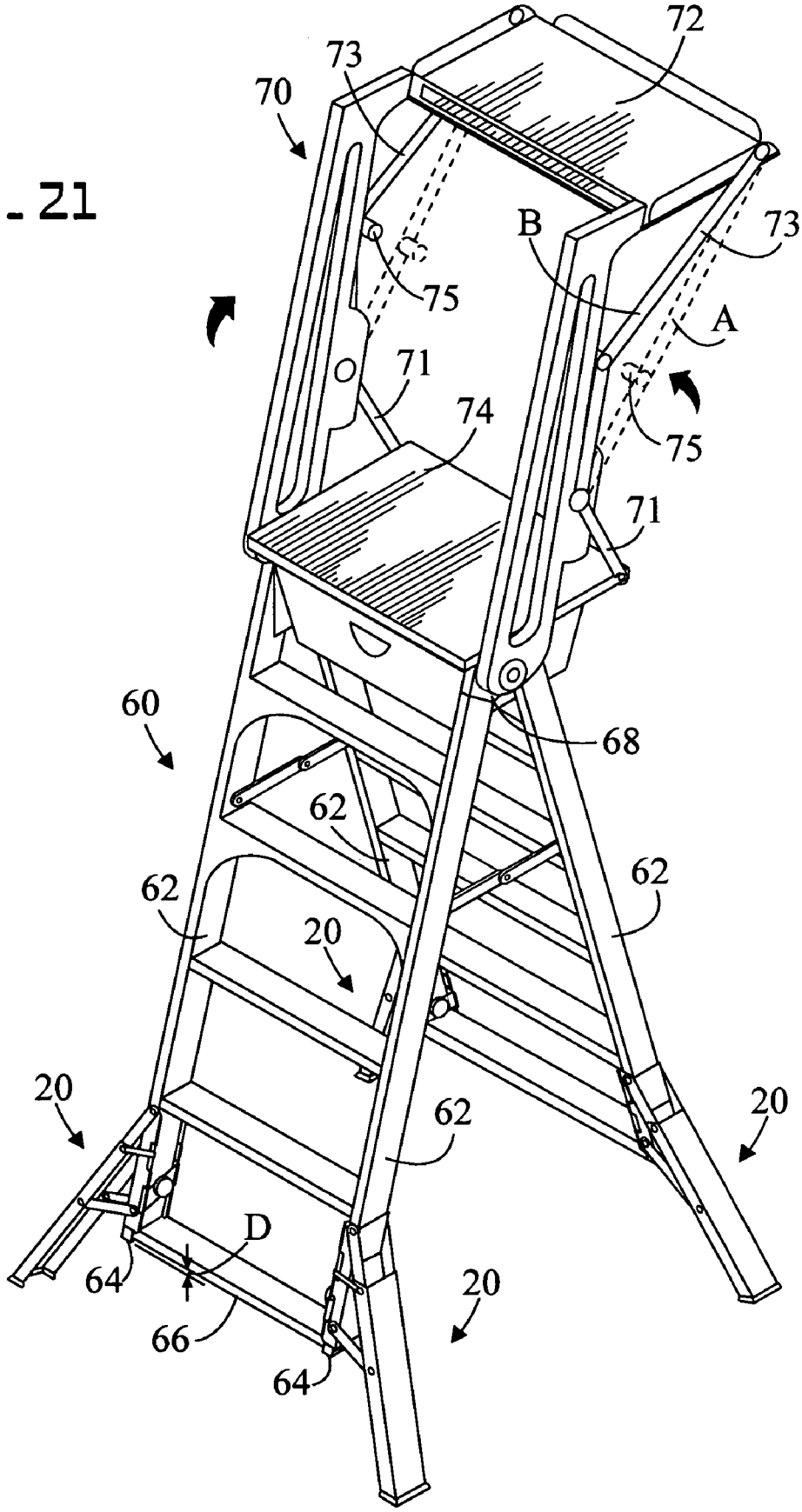
FIG. 21 is a reduced perspective view of a ladder in accordance with the present invention.

FIG. 21 is a reduced perspective view of a ladder in accordance with the present invention, generally designated as 60. Ladder 60 has four legs 62, each leg 62 having a foot 64. Four extenders 20 are attached to the four legs 62 of ladder 60. The four extenders 20 are as previously described herein. Ladder 60 has a lowest rung 66 which is disposed a distance D from the feet 64 of two legs 62. Distance D is six inches or less, so that lowest rung is within six inches of feet 64. By having a lowest rung 66 disposed close to the feet 64 of the two legs 62, when the ladder is elevated by extenders 20 (as shown), a user may conveniently step onto the first rung without having to step up an inordinate distance (which would be the case if lowest rung 66 were not present). Ladder 60 has an enlarged top platform 74 which is suitable for stepping.

Additionally, ladder 60 has an apex 68 (the place at which two opposite legs 62 meet). A support 70 is pivotally connected to apex 68, wherein support 70 may be rotated from an upward extended position (FIG. 21), to a downward position adjacent to two of legs 62 (refer to FIG. 22).

Figure 22:
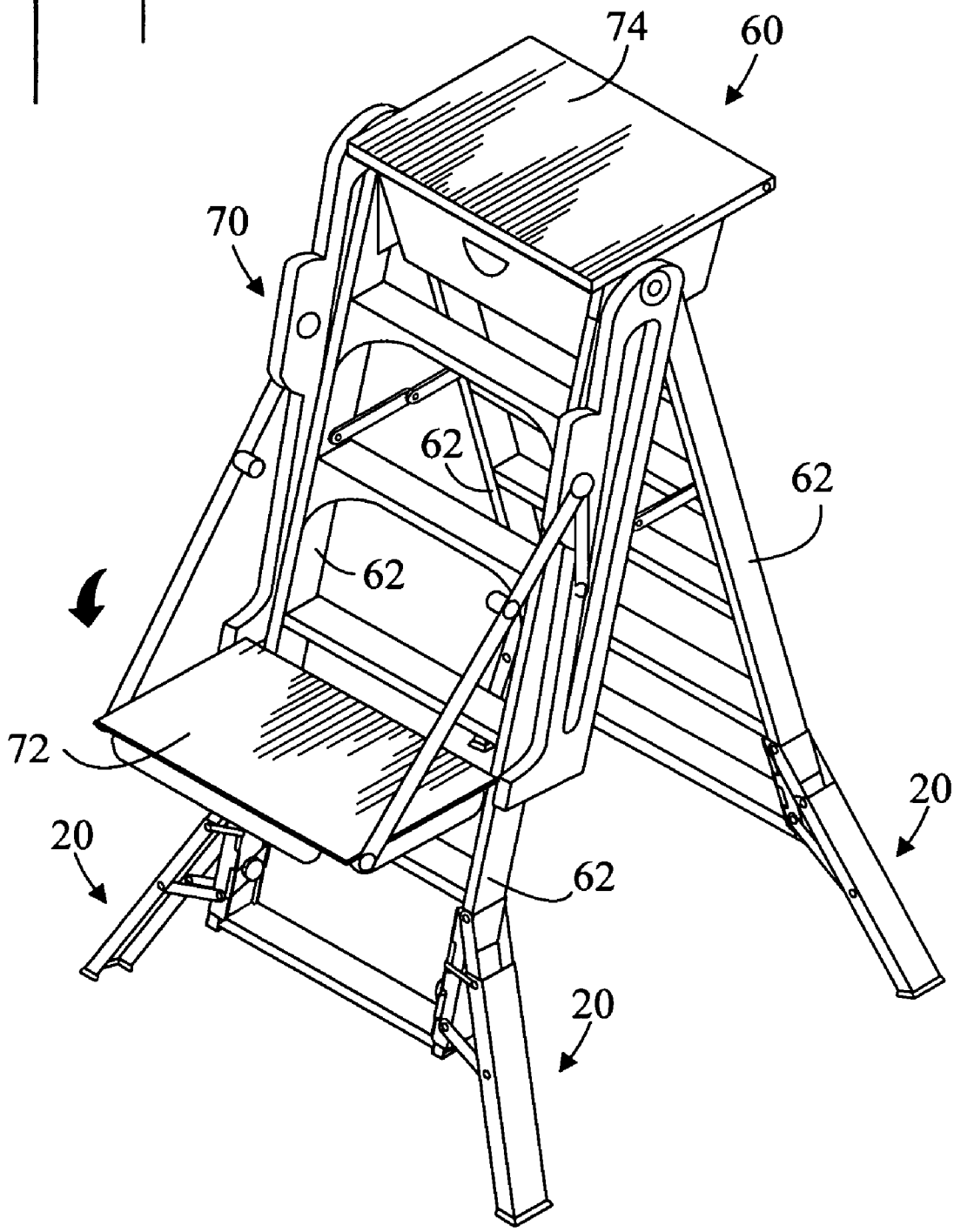
FIG. 22 is a reduced perspective view of the ladder of FIG. 21 with a support rotated to a downward position.

Support 70 has a tray 72 which is disposed in a substantially horizontal position both when support 70 is in the extended position (FIG. 21) and when support 70 is in the downward position (refer to FIG. 22).

Support 70 is secured to top platform 74 by selectively engageable arms 71 which are pivotally attached to support 70. Tray 72 is attached to the body of support 70 by arms 73 which may be moved from an unlocked position A (shown in dashed lines) to a locked position B. When in the locked position, pins 75 of arms 73 abut the body of support 70.

FIG. 22 is a reduced perspective view of the ladder of FIG. 21, with a support 70 rotated to a downward position.

Figure 23:
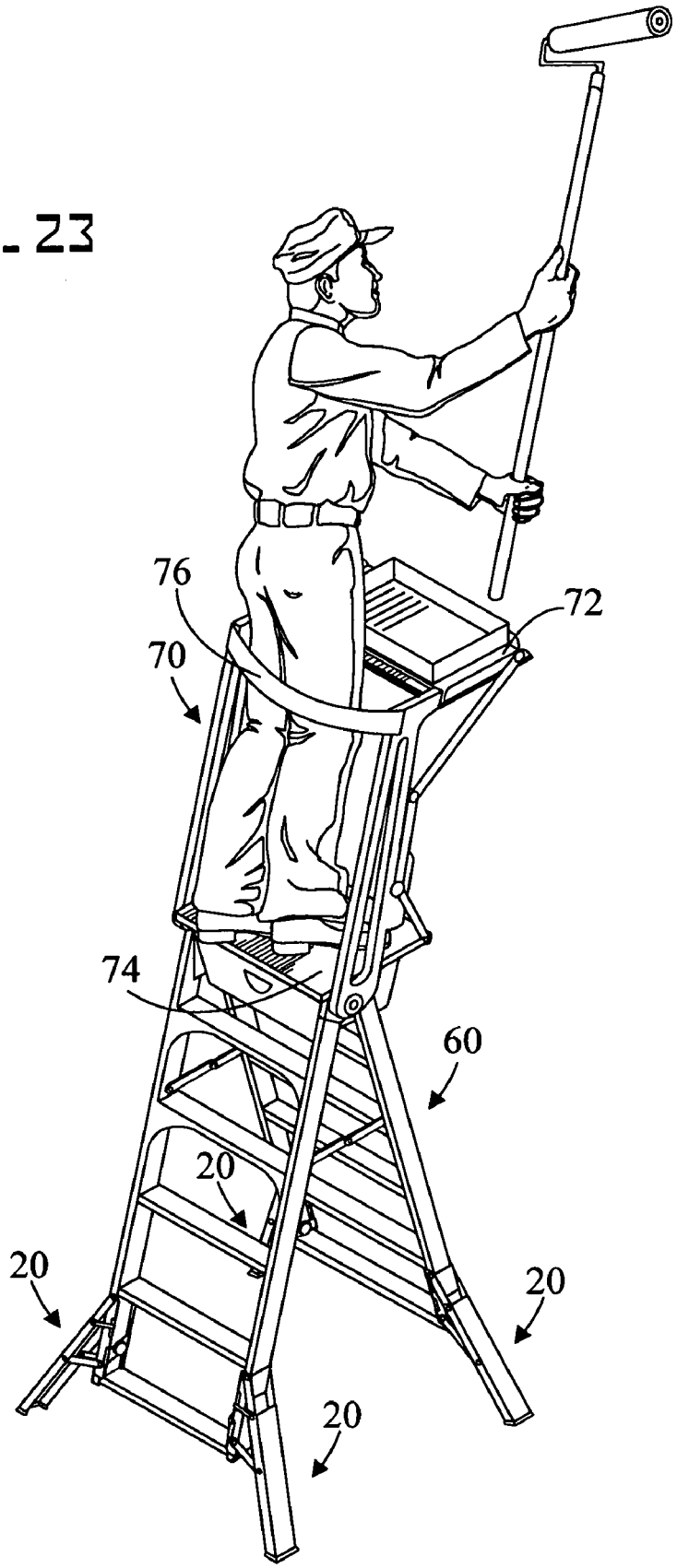
FIG. 23 is a reduced perspective view of ladder of FIG. 21 with the support rotated to the extended position, and a user stepping upon the top platform of the ladder; and, FIG. 24 is a perspective view of the extender installed on the leg of the ladder.

FIG. 23 is a reduced perspective view of ladder 60, with support 70 rotated to the extended position, and a user stepping upon the top platform 74 of ladder 60. Support 70 assists the user in balancing on top of ladder 60. A safety harness 76 can be attached to support 70.

Figure 24:
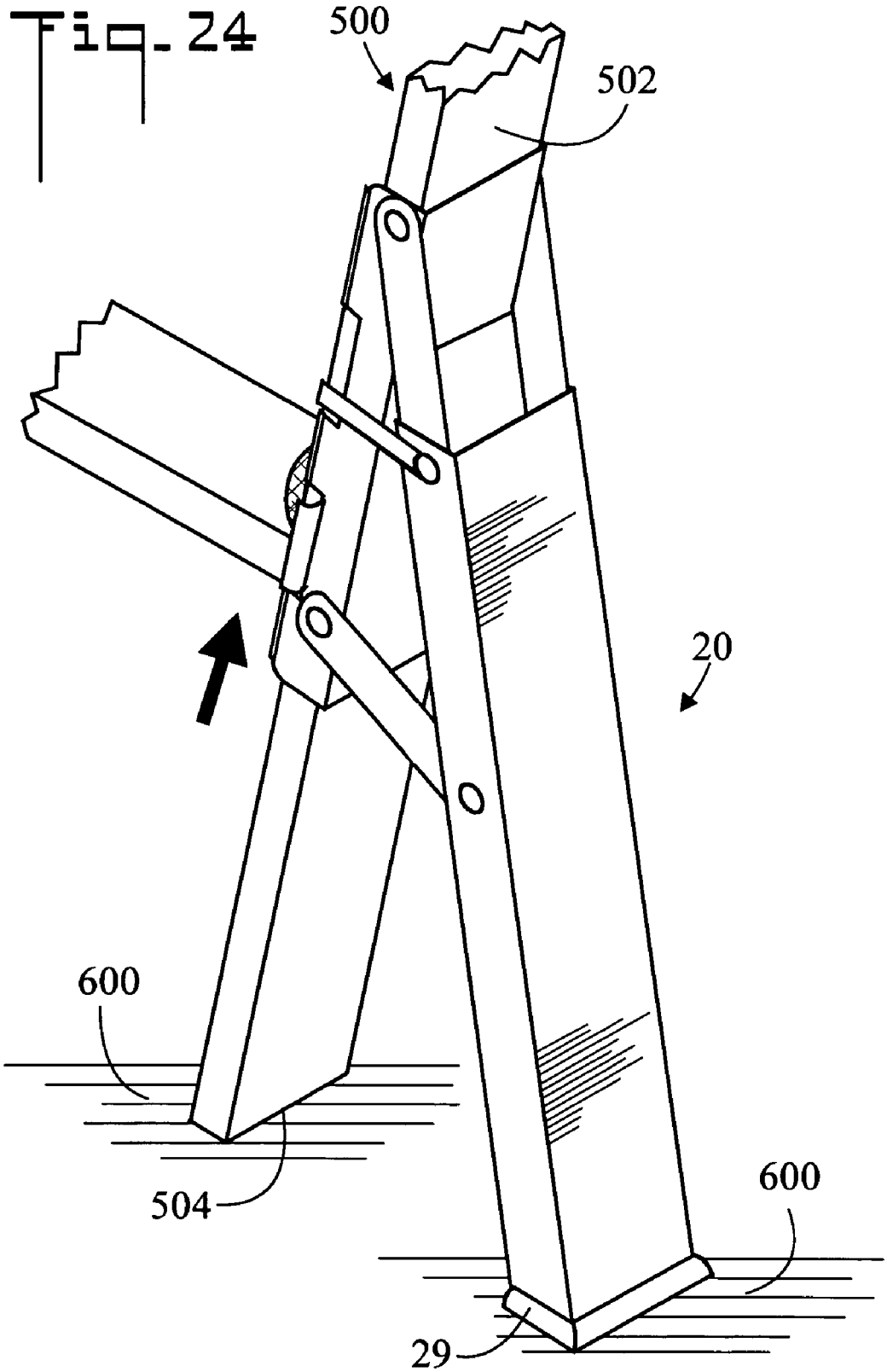

FIG. 24 is a perspective view of extender 20 installed on the leg 502 of a ladder 500. In this embodiment, extender 20 is positioned so that foot 29 of extender 20 is even with the foot 504 of leg 502 of ladder 500. Both foot 29 of extender 20 and foot 504 of ladder 500 reside on support surface 600. In this configuration, extender 20 does not extend the leg 502 of ladder 500, but rather serves as a brace for the leg 502.

It may be appreciated that while the shown embodiments disclose a removable extender 20 which may be selectively attached to the leg 502 of ladder 500, extender 20 could also be permanently connected to leg 502. It may further be appreciated that the principles of the present invention may either be applied to any size ladder, and to ladders having both two and four legs.

In terms of use, a method for extending the leg 502 of a ladder 500, includes (it is noted that as used herein the term extending can mean either lengthening the leg 502 of the ladder 500, or alternatively providing a side brace for the leg 502):

(a) providing a ladder 500 having a leg 502 having a foot 504;

(b) providing an extender 20 for leg 502 of the ladder 500, the extender 20 including:

a first channel 22 shaped and dimensioned to receive leg 502 of ladder 500;

a second channel 24 shaped and dimensioned to receive first channel 22;

a first member 26 pivotally connecting first channel 22 to second channel 24;

a second member 28 pivotally connecting first channel 22 to second channel 24;

wherein second channel 24 may be selectively moved from a stowed position wherein leg 502 is received by first channel 24 and first channel 22 is received by second channel 24, to an extended position wherein second channel 24 outwardly projects from first channel 22 and resides in substantially co-linear relationship with first member 26;

-a lock 30 selectively connectable between first channel 22 and second channel 24 to retain extender 20 in extended position;

a retainer for fixedly attaching extender 20 to leg 502 of ladder 500;

(c) using the retainer to first channel 22 to a desired position along leg 502 of ladder 500 wherein first channel 22 receives leg 502 of ladder 500;

(d) placing second channel 24 in the extended position; and, (e) using lock 30 to retain second channel 22 in the extended position.

The method further including:

in step (b), first member 26 including a first pair of arms 29 connected by a first bridge 33;

first bridge 33 having an edge 35 which contacts first channel 22 when second channel 24 is in the extended position;

in step (b), second member 28 including a second pair of arms 37 connected by a second bridge 39; and, second bridge 39 having an edge 41 which contacts first channel 22 when second channel 24 is in the extended position.

The method further including:

in step (b), the lock including a locking strap 30 pivotally connected to second channel 24, wherein locking strap 30 may be selectively attached to first channel 22.

The method further including:

in step (b), the retainer including:

first channel 22 having two sides, each side having an open rod 32;

an insert 34 selectively connectable between two open rods 32;

a screw 36 threadably connected to insert 34; and, so that insert 34 engages two rods 32 and screw 36 may be turned to engage leg 502 of ladder 500 and thereby fixedly hold first channel 22 in place on leg 502 of ladder 500.

The method further including:

in step (b), first channel 22 including two pairs of open rods 32 wherein insert 34 may be connected between either pair.

The method further including:

in step (b), first member 26 connected to first channel 22 at a first pivot axis P1;

second member 28 connected to first channel 22 at a second pivot axis P2;

first member 26 connected to second channel 24 at a third pivot axis P3;

second member 28 connected to second channel 24 at a fourth pivot axis P4;

a distance from P1 to P2 being L1;

a distance from P2 to P4 being L2;

a distance from P4 to P3 being L3;

a distance from P3 to P1 being L4; and, wherein a ratio of L1 to L2 is about 1.2, a ratio of L1 to L3 is about 1.1, and a ratio of L1 to L4 is about 1.4.

The method further including:

in step (c), positioning extender 20 so that extender 20 extends below foot 504 of leg 502 of ladder 500.

The method further including:

in step (c), positioning extender 20 so that foot 29 of extender 20 is even with foot 504 of leg 502 of ladder 500.

The method further including:

in step (c), positioning extender 20 along leg 502 of ladder 500 so that extender 20 causes ladder 500 to rest evenly on a support surface 600.

The method further including:

in step (a), ladder 500 having four legs 502;

providing three additional extenders 20;

repeating steps (c) through (e) for each leg 502 of ladder 500.

The method further including:

wherein in step (c) four extenders 20 are all attached an equal distance from foot 504 of corresponding legs 502.

The method further including:

wherein in step (c) four extenders 20 are not all attached an equal distance from foot 504 of corresponding legs 502.

The preferred embodiments of the invention described herein are exemplary and numerous modifications, variations and rearrangements can be readily envisioned to achieve an equivalent result, all of which are intended to be embraced within the scope of the appended claims.

What is claimed is:

1. An extender for the leg of a ladder, comprising:

a first channel shaped and dimensioned to receive the leg of the ladder;

a second channel shaped and dimensioned to receive said first channel;

a first member pivotally connecting said first channel to said second channel;

a second member pivotally connecting said first channel to said second channel;

wherein said second channel may be selectively moved from a stowed position wherein said leg is received by said first channel and said first channel is received by said second channel, to an extended position wherein said second channel outwardly projects from said first channel and resides in substantially co-linear relationship with said first member;

a retainer for fixedly attaching said extender to a desired position along the leg of the ladder;

said retainer including:

said first channel having two sides, each said side having an open rod;

an insert selectively connectable between said two open rods;

a screw threadably connected to said insert; and, so that said insert engages said two rods and said screw may be turned to engage the leg of the ladder and thereby fixedly hold said first channel in place on the leg of the ladder.

2. An extender according to claim 1, further including:

said first channel including two pairs of said open rods wherein said insert may be connected between either said pair.

3. An extender for the leg of a ladder, comprising:

a first channel shaped and dimensioned to receive the leg of the ladder;

a second channel shaped and dimensioned to receive said first channel;

a first member pivotally connecting said first channel to said second channel;

a second member pivotally connecting said first channel to said second channel;

wherein said second channel may be selectively moved from a stowed position wherein said leg is received by said first channel and said first channel is received by said second channel, to an extended position wherein said second channel outwardly projects from said first channel and resides in substantially co-linear relationship with said first member;

said first member connected to said first channel at a first pivot axis P1;

said second member connected to said first channel at a second pivot axis P2;

said first member connected to said second channel at a third pivot axis P3;

said second member connected to said second channel at a fourth pivot axis P4;

a distance from P1 to P2 being L1;

a distance from P2 to P4 being L2;

a distance from P4 to P3 being L3;

a distance from P3 to P1 being L4; and, wherein a ratio of L1 to L2 is about 1.2 to 1, and a ratio of L1 to L3 is about 1.1 to 1, and a ratio of L1 to L4 is about 1.4 to 1.

* * * * *